US005936027A

United States Patent [19]

Zahrobsky et al.

[11] Patent Number: 5,936,027

[45] **Date of Patent: *Aug. 10, 1999**

[54] TEXTILE JET INK

[75] Inventors: Peter Zahrobsky, Glen Ellyn; Bruce Lent, Oak Park, both of Ill.

[73] Assignee: Videojet Systems International, Inc., Wood Dale, Ill.

[ * ] Notice: This patent is subject to a terminal disclaimer.

[21] Appl. No.: 08/574,985

[22] Filed: Dec. 19, 1995

Related U.S. Application Data

[63] Continuation of application No. 08/232,730, Apr. 25, 1994, abandoned.

[51] Int. Cl.[6] ..... C08L 83/04; C09D 11/10

[52] U.S. Cl. ..... 524/506; 524/35; 524/261; 524/267; 524/356; 524/389; 524/497; 524/589; 524/510; 524/539; 523/160

[58] Field of Search ..... 524/35, 261, 267, 524/356, 389, 497, 509, 510, 506, 539; 106/23 R, 26 R; 523/160

[56] References Cited

U.S. PATENT DOCUMENTS

| | | | |
|---|---|---|---|
| 4,365,035 | 12/1982 | Zabiak | 523/160 |
| 4,369,279 | 1/1983 | Emerick | 524/445 |
| 4,446,259 | 5/1984 | Vasta | 524/506 |
| 4,567,213 | 1/1986 | Bhatia et al. | 523/160 |
| 4,689,049 | 8/1987 | Burke et al. | 8/552 |
| 4,702,742 | 10/1987 | Iwata et al. | 8/495 |
| 4,716,188 | 12/1987 | Mariusson et al. | 524/506 |
| 4,725,849 | 2/1988 | Koike et al. | 347/106 |
| 4,849,770 | 7/1989 | Koike, et al. | 347/100 |
| 4,969,951 | 11/1990 | Koike et al. | 106/22 C |
| 5,017,223 | 5/1991 | Kobayashi et al. | 106/20 B |
| 5,510,415 | 4/1996 | Zahrobsky et al. | 524/506 |

FOREIGN PATENT DOCUMENTS

| | | | |
|---|---|---|---|
| 0071345A2 | 2/1983 | European Pat. Off. . | |
| 0604105A1 | 6/1994 | European Pat. Off. . | |
| 2385782 | 10/1978 | France . | |
| 0029677 | 2/1982 | Japan | 524/506 |
| 0133172 | 8/1982 | Japan | 523/262 |
| 0180563 | 10/1983 | Japan | 524/506 |
| 0086182 | 5/1985 | Japan | 524/506 |
| 0086183 | 5/1985 | Japan | 524/506 |
| 60-092368 | 5/1985 | Japan . | |
| 61-016884 | 1/1986 | Japan . | |
| 61-213273 | 9/1986 | Japan . | |
| 62-225577 | 10/1987 | Japan . | |
| 62-231787 | 10/1987 | Japan . | |
| 2189373 | 7/1990 | Japan . | |
| 0730771 | 5/1980 | Russian Federation | 524/506 |
| 1603062 | 11/1981 | United Kingdom . | |
| 2088402 | 6/1982 | United Kingdom . | |

OTHER PUBLICATIONS

Database WPI, Derwent Publication Ltd. (82–45491E, Abstract) SU 852982, Sep. 1981.

Database Patent Abstracts of Japan (JP6128513, Abstract), Oct. 5, 1994.

Material Safety data sheet, Dow Corning, p. 11, Dow Corning 6–2230 Resin.

*Primary Examiner*—Marion McCamish
*Assistant Examiner*—John J. Guarriello
*Attorney, Agent, or Firm*—Leydig, Voit & Mayer, Ltd.

[57] ABSTRACT

A jet ink composition for use with textiles which comprises a pigment dispersed with an ethyl cellulose resin, a silicone resin, a phenolic resin, and at least one non-aqueous solvent in which the pigment dispersion, silicone resin, and phenolic resin are dissolved. The printed images formed therefrom are readable even when applied to darkly-dyed textiles.

26 Claims, No Drawings

TEXTILE JET INK

This is a continuation of application Ser. No. 08/232,730 filed on Apr. 25, 1994 now abandoned.

FIELD OF THE INVENTION

This invention relates to the field of ink-jet printing, particularly to ink jet printing on textiles, and more particularly, to a new ink jet ink composition for use in textile applications.

BACKGROUND OF THE INVENTION

Marking methods such as roller printing, screen printing, transfer printing, and stitching or sewing of messages have been used for marking textiles such as woven fabrics, non-woven fabrics, and blended woolen fabrics. However, these conventional methods are expensive and slow, because they require special preparation of the fabric and/or additional manufacturing steps. Therefore, these methods are not economical.

The use of ink jet printing has been proposed as a more economical and flexible method. Because ink jet printing could be done while the textile is on the production line, it would not slow the production process.

Ink jet printing is a well-known technique by which printing is accomplished without contact between the printing device and the substrate on which the printed characters are deposited. Briefly described, ink jet printing involves the technique of projecting a stream of ink droplets to a surface and controlling the flight of the droplets electronically so that they are directed to form the desired printed image on that surface. This technique of non-contact printing is particularly well suited for application of characters onto irregularly shaped surfaces, including, for example, the curved bottom of beverage containers.

In general, an ink jet composition must meet certain rigid requirements to be useful in ink jet printing operations. These relate to viscosity, resistivity, solubility, compatibility of components and wettability of the substrate. Further, the ink must be quick-drying and smear resistant, must be capable of passing through the ink jet nozzle without clogging, and must permit rapid clean-up of the machine components with minimum effort.

Ink jet printing, however, also has several drawbacks. The quality of the print tends to be impaired due to blotting on the cloth, partly because the ink jet printer does not allow the use of an ink having high viscosity and partly because cloth usually has a more uneven texture than paper, thus making it difficult to print patterns of minute or delicate design. This blotting, or spreading, also to date made ink jet printing unsuitable for use in dyed textiles, because when the ink spreads its contrast with the dyed textile is diminished.

In addition, discharge of the ink tends to be unstable, and the response to high frequency is liable to be impaired depending on the physical property of the ink, owing to the fact that the ink has to be discharged through minute nozzles at high velocity and high frequency. Further, print formed from using a conventional ink jet formulation exhibits a slow dye-fixing rate and minimal washing fastness.

Certain ink jet formulations and methods of using them have been proposed to eliminate these problems. U.S. Pat. No. 4,702,742 relates to a method of applying an aqueous dye containing an ink on cloth that has been previously treated with an ink acceptor. The ink is then optionally subjected to a dye-fixing treatment.

U.S. Pat. No. 4,725,849 discloses a process of ink jet printing comprising applying an aqueous dye-containing ink to a cloth that has been pre-treated with an ink receiving material having a viscosity of 1000 centipoises. The ink receiving material may be a water soluble resin-containing solution or a hydrophilic resin-containing solution.

U.S. Pat. No. 4,849,770 relates to an ink jet formulation comprising a reactive dye or reactive dispersing dye, and a solvent composed mainly of water and an organic solvent non-reactive with the dye. This formulation is applied via ink jet printing to a textile, and is then subjected to a dye-fixing treatment.

U.S. Pat. No. 4,969,951 discloses an ink jet formulation comprising a reactive disperse dye and a solvent composed of water, or water and a water-soluble organic solvent. This formulation is applied via ink-jet printing to a textile, and is then subjected to a dye-fixing treatment.

Japanese Patent No. 62225577 relates to an ink jet composition for textile printing operations comprising a pigment, a water-soluble or aqueous dispersible polyester or polyamide, a cross-linking agent, and water.

Japanese Patent No. 61213273 discloses an ink jet composition for use with polyester fibers comprising a water-insoluble pigment, dispersant consisting of a 3:1 ratio of aromatic rings to sulfonate or sulphuric ester group.

Japanese Patent No. 62231787 relates to a method of textile printing using an ink jet composition comprising a pigment and a water-soluble or dispersable polyester or polyamide. The textile to be printed is first treated with a metal salt or cationic compound. The ink is then applied, and is cross-linked by a cross-linking agent present either in the ink or on the textile.

Japanese Patent No. 2189373 discloses an ink jet composition for textile printing operations comprising water-insoluble pigment having particles with a diameter of 0.03–1.0 microns, and a dispersion media, wherein the solution density is 1.010–1.300.

The aforementioned ink compositions and methods of using them also suffer from several drawbacks. First, in some instances it is necessary to pre-treat the textile prior to application of the ink to prevent spreading or blotting. Other of the above-noted patents require chemical fixing treatments after the ink has been applied. Further, all of the aforementioned ink formulations and methods relate to dark-colored inks for use on white or light colored textiles. These inks are not visible if the textile is a dark color, such as navy blue, maroon, or black.

Therefore to date, there has been no white or pastel-colored ink formulation for ink jet printing on textiles. There exists a need for such inks in the industry. Currently, fabrics are coded with brand names, sizes, or color information by stitching or contact printing. This step is inefficient, however, because it slows down production.

SUMMARY OF THE INVENTION

The present invention overcomes the problems associated with prior art ink compositions for ink jet printing on dark colored textiles, and achieves distinct advantages thereover. The ink compositions of the present invention contain hydrophobic components and, therefore, resist being drawn into water-dampened textile substrates. In accordance with one aspect of the present invention, an ink jet ink composition is provided comprising a pigment dispersed with an ethyl cellulose resin, a silicone resin, a phenolic resin, and a non-aqueous solvent. It is now possible to formulate ink jet ink compositions for printing on textiles that have good adherence to a variety of textiles.

The ink compositions of the present invention may also comprise, and preferably do comprise, in addition to the four components mentioned above, a dispersing agent, a plasticizer, and an electrolyte.

DETAILED DESCRIPTION OF PREFERRED EmBODIMENTS

Pigment

The pigment used in the present invention should have a color that contrasts with the substrate to which it is to be applied. The maximum particle size of the pigment should also be less than about 1 micron in diameter. The preferred pigment for use in the inks of the present invention is titanium dioxide.

In order to obtain pigment particles of useful size for incorporation into an ink jet ink, pigment is ground with a non-reactive binder resin which separates pigment particles and prevents them from coalescing via electrostatic interaction. The resultant solid/solid dispersion, referred to as pigment "chip", maintains pigment particle size until the pigment is ready to be incorporated into the ink. The ratio of pigment to binder resin in the supplied chip is usually about 1:1 to 9:1, with a preferred ratio of about 75% pigment to 25% binder resin by weight of the chip. Useful binder resins for the current invention include acrylic, vinyl, modified rosin ester, or ethyl cellulose. Useful pigments include organic pigments, aluminum silicate, or titanium dioxide. The preferred chip in the ink of current invention contains titanium dioxide pigment and ethyl cellulose binder resin. This chip is available under the trade name Microlith White R-A, from Ciba-Geigy corporation.

During formulation of the ink composition of the present invention, chip binder resin is dissolved by the ink solvent. The pigment is preferably kept from agglomeration by a dispersing agent. It is believed that the dispersing agent chemically binds with pigment particles creating a steric shield around each particle and stabilizing the solid/liquid dispersion of the ink. The dissolved binder resin, along with each of the other resins added, aids in maintaining the solid/liquid ink dispersion by increasing bulk solution viscosity which, in turn, reduces particle settling.

The pigment typically is present in an amount from about 4% to about 15% by weight of the ink composition. Preferably, from about 4% to about 8% of pigment by weight of the ink composition should be present.

Silicone Resin

The silicone resin binds the pigment to the substrate, disperses the pigment, and prevents the ink composition from spreading on the substrate, especially if the textile has been pretreated with water. It is dissolved in the ink composition. The preferred silicone resin is diphenyl, methyl, phenyl, phenyl methyl silicone, available under the trade name DC6-2230 from Dow Corning.

The silicone resin typically is present in an amount from about 3% to about 20% by weight of the ink composition, with from about 3% to about 7% by weight being preferred.

Phenolic Resin

The phenolic resin also binds the pigment to the substrate, disperses the pigment, and prevents the ink composition from spreading on the substrate, especially if the textile has been pretreated with water. The phenolic resin also imparts laundering resistance to the printed message or code. It is dissolved in the ink. Phenolic resins useful in the ink compositions of the present invention include phenol-formaldehydes, bisphenol A phenol-formaldehydes, and butylated phenol-formaldehydes. The preferred phenolic resin is a bisphenol A phenol-formaldehyde, available under the trade name Varcum 29-108, from Occidental Chemical Co.

The phenolic resin typically is present in an amount from about 1% to about 20% by weight of the ink composition, with from about 1% to about 4% by weight being preferred.

Solvent

The solvent dissolves and/or suspends the ink components, and keeps the ink composition in a fluid state so that the ink will flow readily through the head of the ink jet printing device. Solvents useful in the ink compositions of the present invention include alcohols and ketones, which may be used alone or in admixture. Particularly useful are ethanols denatured with isopropanol and n-propyl acetate, and methyl isobutyl ketone. The preferred denatured ethanol is available as Duplicating Fluid 100C.NPA from Petro Products. The solvent system should be non-aqueous, that is, containing not more than about 5% water.

The solvent typically is present in an amount from about 40% to about 95% by weight of the ink composition, with an amount from about 60% to about 80% by weight being preferred.

Other Components

An electrolyte can also be used in the ink compositions of the present invention to ensure that the ink composition has suitable electrical conductivity, especially if the ink is to be used in continuous ink jet printing. The electrolyte is usually an inorganic salt, with potassium thiocyanate or lithium nitrate being preferred. The electrolyte usually is present in an amount up to about 3% by weight of the ink composition, with an amount up to about 1.5% being preferred.

Dispersing agents can be present in the ink composition of the present invention to prevent agglomeration of pigment particles, such as titanium dioxide particles in the ink. Preferred dispersing agents are Disperbyk 163, available from BYK Chemie USA. BYK-P-104S, available from BYK Chemie USA, Anti-Terra-U, also available from BYK Chemie USA, and Nopcosperse, available from Henkel Corp., are also useful. The dispersing agent usually is present in an amount up to about 1.5% by weight of the ink composition, with an amount up to about 0.5% being preferred.

Further, a plasticizer, such as Santicizer 8, available from Monsanto, may be used to soften the resin component of the ink, so that the ink does not "flake off" the substrate after application. The plasticizer usually is present in an amount up to about 3% by weight of the ink composition, with an amount up to about 1.5% being preferred.

The present invention may also comprise other additives, which may be any substance that can enhance the ink composition with regard to (a) improved solubility of other components, (b) improved adhesion of the ink to the substrate, (c) improved print quality, and (d) control of wetting characteristics, which may be related to such properties as surface tension and viscosity, among other properties.

For example, antioxidants and/or UV light stabilizers can be used in combination or separately. Useful antioxidants include hindered phenols, such as BHT, TBHQ, and BHA, which are sold under the trade names Tenox (Eastman Chemical Products), Ethanox (Ethyl Corp.), and Irgazox (Ciba-Geigy). Light stabilizers for ultraviolet and visible light include hindered amines such as Tinuvin 770, 765, and 622, and substituted benzotrioles such as Tinuvin P326, 327, and 328, all of which are available from Ciba-Geigy. Also, substituted benzophenones Cyasorb UV-531, UV-24, and UV-9, available from American Cyanamid Co. can be used.

General Considerations

The viscosity of the ink compositions of the present invention is generally from about 2 to about 8 centipoises, and preferably is from about 4.0 to about 5.5 centipoises. The viscosity of a given ink composition can be adjusted depending on the specific components used therein, and such adjustment is with the skill of those in the art.

Printed images may be generated with the ink compositions of the present invention by incorporating the inks into a continuous or drop-on-demand ink jet printer, and causing droplets of the ink to be ejected in an imagewise pattern onto a substrates such as textiles. Suitable printers for employing the ink compositions of the present invention include commercially available ink jet printers.

The formulated jet inks of the present invention will exhibit the following characteristics: (1) a viscosity from about 2 to about 8 centipoises (cps) at 25° C., (2) an electrical resistivity from about 50 to about 2,000 ohms-cm-$^{-1}$, (3) a sonic velocity from about 1,200 to about 2,000 m/sec., (4) a surface tension below 28 dynes/cm, (5) a pH in the range of from about 3 to about 9, and (6) a specific gravity from about 0.8 to about 1.1.

The ink compositions of this invention can be applied to a wide range of dark colored textiles. However, the invention is of special use in forming images on dark colored nylon, cotton, acrylic, or wool textiles.

When the ink compositions of the present invention are applied to dark colored textiles, the image formed by the ink will not spread and will be easily visible. The print color contrast of the ink with dark colored textile can be enhanced by pre-treating the textile with water. Post-treating the printed textile with either dry or steam heat is necessary to "fix" the print, making it resistant to laundering.

The present invention is further illustrated by the following example.

Example

| Material | % By Weight |
|---|---|
| Duplicating Fluid 100 C.NPA | 69.9 |
| DC 6-2230 Silicone Resin | 5.3 |
| Methyl Isobutyl Ketone | 12.7 |
| Varcum 29-108 | 2.6 |
| Disperbyk 163 | 0.5 |
| Microlith White R-A | 7.5 |
| Saniticzer 8 | 0.5 |
| Potassium Thiocyanate | 1.0 |
| | 100.0 |

An ink containing the above components was formulated as follows:

The silicone resin was added to approximately one-forth (¼) of the total Duplicating Fluid 100C.NPA to be used. All of the methyl isobutyl ketone was then added. Varcum 29-108 was next added, followed by Disperbyk 163 dispersing agent, followed by the Microlith White R-A chip, followed by the addition of Plasticizer 8. After each addition, the solution was mixed until the added component was dissolved or dispersed. After the Plasticizer 8 was added, the solution was mixed at high speed, using a dispersion blade, for 60 minutes. The remainder of the Duplicating Fluid 100C.NPA was then added, followed by the potassium thiocyanate. Again, the ink was mixed after each addition. After addition of the potassium thiocyanate, the ink was filtered and bottled.

The ink made according to the above procedure had a viscosity of 4.8 centipoises, a resistivity of 850 ohms-cm, a specific gravity of 1.0, a pH of 7.4, and a surface tension of 23.4 dynes/cm. The ink was then used to print a message on black nylon, cotton & acrylic socks. The resulting message was white, and exhibited excellent color contrast and stability.

We claim:

1. An ink jet ink composition for use with textiles, comprising a pigment dispersed with a resin selected from the group consisting of acrylic resin, vinyl resin, modified rosin esters, and ethyl cellulose resin; a silicone resin; a phenolic resin; and at least one non-aqueous solvent, where the pigment is present in an amount from about 4% to about 15% by weight of the ink composition, the resin selected from the group consisting of acrylic resin, vinyl resin, modified rosin esters, and ethyl cellulose resin is present in an amount from about 0.4% to about 15% by weight of the ink composition, the silicone resin is present in amount from about 3% to about 20% by weight of the ink composition, and the Phenolic resin is present in an amount from about 1% to about 20% by weight of the ink composition, where the ink composition contains less than about 5% water by weight of the ink composition, and where the ink composition has a viscosity from about 2 to about 8 centipoises at 25° C., an electrical resistivity from about 50 to about 2,000 ohms-cm$^{-1}$, and a sonic velocity from about 1,200 to about 2,000 m/sec.

2. The ink composition of claim 1, wherein the pigment is titanium dioxide.

3. The ink composition of claim 2, wherein the titanium dioxide is present in an amount from about 4% to about 15% by weight of said ink composition.

4. The ink composition of claim 1, wherein the silicone resin is diphenyl, methyl, phenyl, phenyl methyl silicone.

5. The ink composition of claim 1, wherein the solvent is selected from the group consisting of alcohols and ketones.

6. The ink composition of claim 1, additionally comprising a dispersing agent.

7. The ink composition of claim 6, additionally comprising an electrolyte.

8. The ink composition of claim 7, additionally comprising a plasticizer.

9. An ink jet ink composition for use with textiles, comprising a pigment, a resin selected from the group consisting of acrylic resin, vinyl resin, modified rosin esters, and ethyl cellulose resin; a silicone resin; a phenolic resin; and at least one non-aqueous solvent, where the pigment is present in an amount form about 4% to about 15% by weight of the ink composition, the resin selected from the group consisting of acrylic resin, vinyl resin, modified rosin esters, and ethyl cellulose resin is present in an amount from about 0.4% to about 15% by weight of the ink composition, the silicone resin is present in amount from about 3% to about 20% by weight of the ink composition, and the phenolic resin is present in an amount from about 1% to about 20% by weight of the ink composition, where the ink composition contains less than about 5% water by weight of the ink composition, and where the ink composition has a viscosity from about 2 to about 8 centipoises at 25 C., an electrical resistivity from about 50 to about 2,000 ohms-cm−1, and a sonic velocity form about 1,200 to about 2,000 m/sec.

10. A method for using ink jet printing to obtain a visible printed image on a dyed textile, comprising jetting onto said textile the ink composition of claim 9.

11. The method of claim 10, further comprising treating said textile with water prior to application of said ink composition, and applying heat to said textile after application of said ink composition.

12. The ink composition of claim 9, wherein the pigment is titanium dioxide.

13. The ink composition of claim 12, wherein the titanium dioxide is present in an amount from about 4% to about 15% by weight of the ink composition.

14. The ink composition of claim 9, wherein the phenolic resin is bisphenol A phenol-formaldehyde.

15. The ink composition of claim 9, wherein the silicone resin is diphenyl, methyl, phenyl, phenyl methyl silicone.

16. The ink composition of claim 9, wherein the solvent is selected from the group consisting of alcohols and ketones.

17. The ink composition of claim 9, additionally comprising a dispersing agent.

18. The ink composition of claim 17, additionally comprising an electrolyte.

19. The ink composition of claim 18, additionally comprising a plasticizer.

20. An ink composition for use in ink jet printing of textiles, comprising titanium dioxide dispersed with an ethyl cellulose resin, a silicone resin, a phenolic resin, a dispersing agent, an electrolyte, and a plasticizer, and at least one non-aqueous solvent, wherein the weight ratio of ethyl cellulose resin to titanium dioxide is approximately 1:3 and the titanium dioxide is present in an amount from about 4% to about 15% by weight of said ink composition, said silicone resin is present in an amount from about 3% to about 20% by weight of said ink composition, said dispersing agent is present in amount less than about 1.5% by weight of said ink composition, said electrolyte is present in an amount less than about 3.0% by weight of said ink composition, said plasticizer is present in an amount less than 3.0% by weight of said ink composition, and said non-aqueous solvent is present in an amount from about 40% to about 95% by weight of such ink composition, where the ink composition contains less than about 5% water by weight of the ink composition, and where the ink composition has a viscosity from about 2 to about 8 centipoises at 25° C., an electrical resistivity from about 50 to about 2,000 ohms-cm$^{-1}$, and a sonic velocity from about 1,200 to about 2,000 m/sec.

21. The ink composition of claim 15, wherein said silicone resin is diphenyl, methyl, phenyl, phenyl methyl silicone.

22. The ink composition of claim 20, wherein said phenolic resin is bisphenol A phenol-formaldehyde.

23. The ink composition of claim 20, wherein said electrolyte is potassium thiocyanate.

24. A method for using ink jet printing to obtain a visible printed image on a dyed textile, comprising jetting onto said textile the ink composition of claim 1.

25. The method of claim 24, further comprising treating said textile with water prior to application of the ink composition, and applying heat to said textile after application of said ink composition.

26. An ink composition for use in ink jet printing of textiles, comprising titanium dioxide, an ethyl cellulose resin, a silicone resin, a phenolic resin, a dispersing agent, an electrolyte, and a plasticizer, and at least one non-aqueous solvent, wherein the weight ratio of ethyl cellulose resin to titanium dioxide is approximately 1:3 and the titanium dioxide is present in an amount from about 4% to about 15% by weight of said ink composition, said silicone resin is present in an amount from about 3% to about 20% by weight of said ink composition, said dispersing agent is present in amount less than about 1.5% by weight of said ink composition, said electrolyte is present in an amount less than about 3.0% by weight of said ink composition, said plasticizer is present in an amount less than 3.0% by weight of said ink composition, and said non-aqueous solvent is present in an amount from about 40% to about 95% by weight of such ink composition, where the ink composition contains less than about 5% water by weight of the ink composition, and where the ink composition has a viscosity from about 2 to about 8 centipoises at 25° C., an electrical resistivity from about 50 to about 2,000 ohms-cm$^{-1}$, and a sonic velocity from about 1,200 to about 2,000 m/sec.

* * * * *